United States Patent [19]

Wisebaker et al.

[11] Patent Number: 4,549,425

[45] Date of Patent: Oct. 29, 1985

[54] FORGING MACHINE TRANSFER WITH MISALIGNMENT DETECTOR

[75] Inventors: Robert E. Wisebaker; Richard Edmondson, both of Tiffin, Ohio

[73] Assignee: The National Machinery Company, Tiffin, Ohio

[21] Appl. No.: 539,523

[22] Filed: Oct. 6, 1983

Related U.S. Application Data

[63] Continuation-in-part of Ser. No. 513,700, Jul. 14, 1983, abandoned.

[51] Int. Cl.[4] ..... B21J 13/10

[52] U.S. Cl. ..... 72/422; 72/405; 901/34; 269/254 R

[58] Field of Search ..... 72/1, 3, 4, 26, 405, 72/422; 901/33, 34, 35; 269/254 R

[56] References Cited

U.S. PATENT DOCUMENTS

| | | | |
|---|---|---|---|
| 3,165,766 | 1/1965 | Wisebaker | 10/76 |
| 3,466,917 | 9/1969 | Eakin et al. | 72/354 |
| 3,656,139 | 4/1972 | Wintriss | 72/4 |
| 3,797,293 | 3/1974 | Paramonoff | 72/26 |
| 3,824,674 | 7/1974 | Inoyama et al. | 901/34 |
| 3,965,718 | 6/1976 | Kline | 72/405 |
| 4,132,318 | 1/1979 | Wang et al. | 901/34 |

*Primary Examiner*—Lowell A. Larson
*Attorney, Agent, or Firm*—Pearne, Gordon, Sessions, McCoy, Granger & Tilberry

[57] ABSTRACT

A misalignment detector for forging machine transfers is disclosed. Such transfers provide grippers which move from a first position in which workpieces are not present to a second position when a workpiece is properly gripped. If a misaligned workpiece is present, the gripper moves to a third position beyond the second position. Each of the embodiments provides a beam-type spring mounted for deflection as the associated gripper or grippers move between the three positions. In some embodiments, the spring is bent as a function of the relative position of two opposed grippers and in other embodiments a spring is associated with a single gripper and is bent as a function of the gripper position. In some embodiments, strain gauges are mounted on the springs to produce a modulated signal to indicate the gripper position and operate the machine's emergency stop if necessary. In one embodiment, the spring is associated with a pneumatic system and allows a bleed orifice to open when misalignment is present. Opening of the bleed orifices creates a pressure drop and actuates a signal generating switch.

16 Claims, 12 Drawing Figures

FORGING MACHINE TRANSFER WITH MISALIGNMENT DETECTOR

BACKGROUND OF THE INVENTION

This is a continuation-in-part of my copending application Ser. No. 513,700, filed July 14, 1983, now abandoned.

This invention relates generally to transfers for forging machines and the like, and more particularly to a transfer of such type providing novel and improved means to determine when a workpiece is properly gripped in the transfer, to determine the absence of a workpiece, and to determine when a workpiece is misaligned and the extent of such misalignment.

PRIOR ART

Automatic transfers for forging machines are well known. Such transfers usually operate to grip a workpiece or blank at one location or work station, and to transfer and position the workpiece at a subsequent work station where it is formed by tools and dies. Examples of such transfers are illustrated in U.S. Pat. Nos. 3,165,766; 3,466,917; and 3,965,718 (all assigned to the assignee of the present invention).

It is also known to provide such a transfer with signal means which operate to produce a signal in the event the transfer grippers are caused to remain open by some predetermined amount. Such signal is generated, for example, if a workpiece hangs up in the tooling at the pickup or gripping position, or if the workpiece is sufficiently misaligned to hold the grippers open such predetermined amount. Such signal indicates that if the machine is not immediately stopped, a "wreck" will occur, causing severe damage to the tooling, and possible damage to the machine itself. The signal is used to operate the emergency stop mechanism of the machine.

In such machines, the signal is generated only if the grippers are held open some predetermined amount and the signal generating system cannot provide any indication of the absence of the workpiece or any indication that the workpiece is properly gripped. Further, such system requires relatively large gripper displacements to properly operate.

SUMMARY OF THE INVENTION

In accordance with one embodiment of the present invention, a forging machine transfer is provided with a novel and improved, simple and reliable sensing system which produces a signal which is a direct function of the gripper positions when the grippers close or attempt to close on a workpiece. Since the signal generated is a function of gripper position, it is used to determine if a workpiece is properly gripped, if no workpiece is gripped, and the extent of misalignment if the workpiece is improperly aligned in the gripper. Further, if desired, the signal may be used to provide a measurement of workpiece size.

Such signal is transmitted to a control system which provides the machine operator with a visual indication of the gripper operation, and, depending on the setting of the control, operates the machine's emergency stop system if the gripper position deviates a sufficient amount to create a problem, such as a "wreck."

In the illustrated embodiments of this invention, the transfer is of the type illustrated in U.S. Pat. No. 3,965,718, supra, and such patent is incorporated herein by reference in its entirety to illustrate the structural detail and drive system for the transfer.

In some illustrated embodiments, deflectable beams are connected to the grippers so that the degree of deflection of the beam is a direct function of the gripper position. In one illustrated embodiment, a single beam having a strain gauge mounted thereon is mounted on one gripper and provided with a free end which is moved by the other gripper of the gripper pair so that the strain gauge produces a signal which is a function of the relative positions of each of the grippers of a pair of grippers.

In another embodiment illustrated, a pair of beams are provided, one for each gripper of the pair of grippers. Here again, strain gauges are mounted on the beams. In this embodiment, there are two signals generated in which each signal provides an indication of the position of the gripper associated with the signal generating strain gauge.

In a third embodiment, a single deflectable beam is again carried by one gripper of a pair of grippers and is deflected an amount determined by the relative position of the grippers. In this embodiment, a signal generating sensor determines the position of the free end of the beam, and produces a signal which is a function of the relative positions of the two grippers of each pair of grippers.

In each of the aforementioned embodiments, a modulated signal is created which has a value which is a direct function of the position of the grippers, with respect either to each other or to the machine transfer. Such signal is supplied to an electronic control system, which provides a visual indication of the signal value to the machine operator and which is conveniently set to operate the emergency stop system of the machine if the signal deviates from normal a sufficient amount to produce likelihood of a wreck.

If, for example, the tooling installed on the machine is of a type which can be damaged if the machine is operated without workpieces, the control is set so that in the event that a workpiece is not gripped and is totally absent, the emergency stop mechanism is operated. Further, the control is set so that if the deviation from normal gripping is a sufficient amount to indicate sufficient misalignment to create danger of a wreck, the emergency stop mechanism is operated to protect the tooling and the machine. Because the signal which is generated and utilized to control the machine has a value which is a direct function of the gripper positions, very small deviations from normal signals can be utilized to control the machine, and it is not necessary to have substantial displacements from normal to create usable control signals.

In still another embodiment, a pneumatic gripper sensing system is provided. In such embodiment, a resilient spring associated with each gripper normally closes a bleed orifice. However, if either gripper is displaced out from the position it assumes when a blank is properly gripped, the bleed orifice opens and generates a signal which informs the operator that a problem exists or which may be used to automatically stop the machine.

Further aspects of this invention are illustrated in the accompanying drawings and more fully described in the following specification.

DETAILED DESCRIPTION OF THE DRAWINGS

Figure 1:
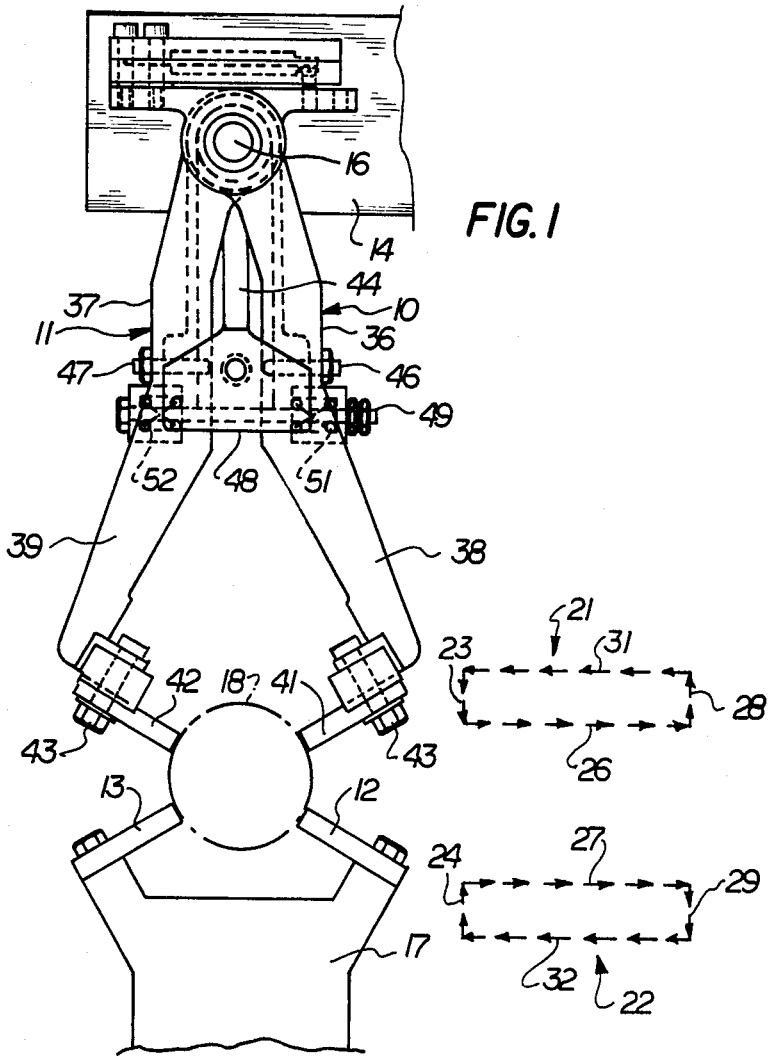
FIG. 1 is a side elevation of a gripper assembly incorporating a first embodiment of this invention, in which a strain gauge sensor produces a signal which is a function of the relative positions of two grippers of a pair of grippers.
Figure 2:
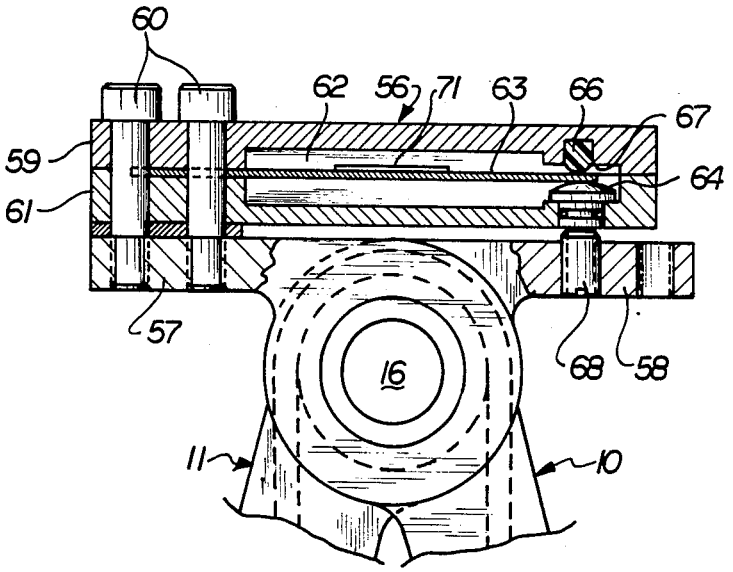
FIG. 2 is an enlarged, fragmentary view, partially in section, illustrating the sensor and signal generating portion of the apparatus.
Figure 3:
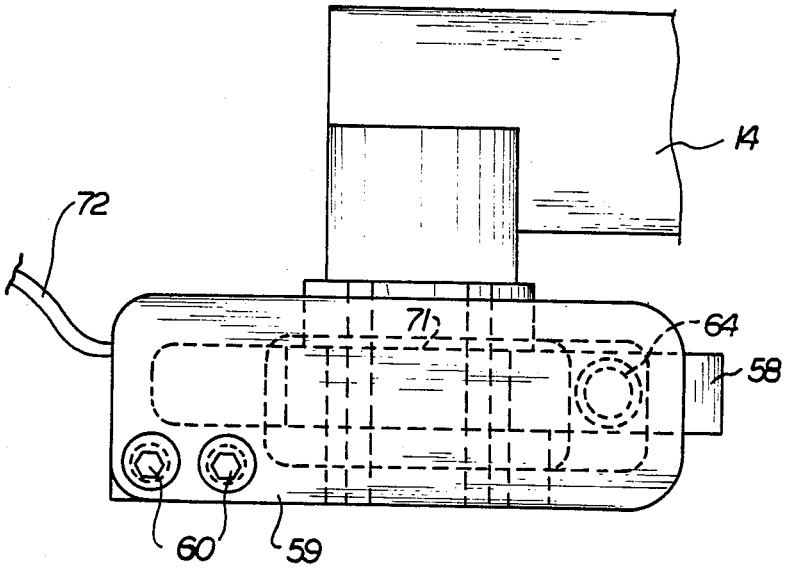
FIG. 3 is a plan view of the sensor and signal generator of FIG. 2.

FIGS. 1 through 3 illustrate a first embodiment. In this embodiment, a gripper assembly includes a pair of similar but opposed pivoted grippers 10 and 11 and a pair of fixed grippers 12 and 13. The pivoted grippers 10 and 11 are mounted on an upper transfer support 14 for pivotal movement relative thereto about a common pivot axis 16. The lower or fixed grippers 12 and 13 are mounted on a lower support 17. In a particular embodiment illustrated, a cylindrical workpiece 18, illustrated in phantom, is gripped at four locations by the grippers.

In this particular transfer, which is of the types disclosed in detail in U.S. Pat. No. 3,965,718, supra, the supports 14 and 17 move toward each other at the gripping location, causing the grippers to grip a workpiece at such location. As indicated by the arrow diagrams in FIG. 1, the upper support follows a movement pattern as illustrated in the diagram 21 and the lower support 17 moves as illustrated in the diagram 22.

For gripping, the two supports move together, as indicated by the arrows 23 and 24 to cause gripping of the workpiece 18. The supports then move horizontally to the delivery location, as indicated by the arrows 26 and 27. Such movement occurs while the grippers are closed on the workpiece. Upon reaching the delivery position, the gripper supports move apart, as indicated by the arrows 28 and 29, to release the workpiece by moving the grippers apart. The supports then move back to the gripping position along a line indicated by the arrows 31 and 32, completing one transfer cycle. The manner in which these movements are produced and the structure for producing such movements are illustrated in U.S. Pat. No. 3,965,718, which has been incorporated herein by reference, and reference should be made to such patent for a detailed disclosure. It should be understood, however, that the present invention can be applied to other types of transfers, and that the present invention is not limited to the particular transfer system illustrated in such patent.

The two pivoted grippers 10 and 11 have lower portions which are essentially mirror opposites of each other. Each provides first depending portions 36 and 37, which are laterally spaced and essentially parallel to each other. From the lower end of the portions 36 and 37, the two grippers provide depending and diverging portions 38 and 39. Mounted at the lower end of each of the diverging portions 38 and 39 is an associated gripper finger 41 and 42, which are secured in position by bolt fasteners 43. A keeper assembly 44 extends down between the two depending portions 36 and 37 and provides opposite faces against which adjustable screws 46 and 47 abut to limit the inward movement of the two grippers 10 and 11 to a position determined by the adjustment of the screws 46 and 47. Keeper portions 48 extend out along the front and back faces of the grippers 10 and 11 to ensure that they are maintained in a coplanar arrangement as they pivot in and out. A spring system is provided to bias the grippers toward each other, and includes a through bolt 49 and a pair of springs 51 and 52 which operate to apply a resilient force to the grippers, urging the grippers toward each other, so that the adjustment screws 46 and 47 are normally maintained against the stop surfaces when a workpiece 18 is not being gripped. However, when the fingers 41 and 42 grip a workpiece, the two grippers are caused to spread against the action of the springs 51 and 52 an amount which is determined by the size and position of the workpiece. In such instance, the gripper 10 rotates about the pivot 16 in an anticlockwise direction, and a gripper 11 rotates in a clockwise direction around the pivot 16.

Mounted at the upper ends of the grippers is a signal producing assembly 56, best illustrated in FIGS. 2 and 3. The upper ends of the two grippers 10 and 11 are provided with crossover projections, with the gripper 10, which is on the right side as viewed in FIG. 2, providing a lateral projection 57 on the left side of the pivot 16, and the gripper 11, which is on the left side as viewed in FIG. 2, providing a lateral projection 58 extending to the right of the pivot 16.

Bolted to the projection 57 by bolts 60 is a housing consisting of first and second housing members 59 and 61. Such housing members define a cavity 62 across which a deflectable beam 63 extends. The left end of the beam 63 is securely mounted between the two housing members 59 and 61, and a free end of the beam is positioned at the opposite extremity of the cavity 62. Mounted in the housing member 61 adjacent the free end of the beam 63 is a small plunger 64 which is slidable in a bore formed in the housing member 61. Such plunger is provided with a seal to prevent dirt or other debris from entering the cavity 62 and a head portion which limits the downward travel of the plunger and also engages the lower side of the free end of the beam 63.

Positioned in a blind bore in the housing member 59 is an elastomeric spring 66 which engages the side of the beam opposite the plunger and provides a resilient force urging the free end of the beam in the direction of the plunger. Around the spring 66, the housing member 59 provides a stop surface 67 which limits the movement of the free end of the beam 63 in an upward direction.

A setscrew 68 is threaded into the projection 58 immediately below the plunger, and is adjusted to engage the plunger and move it upwardly, as viewed in FIG. 2, when the gripper 11 rotates relative to the gripper 10 in an anticlockwise direction to indicate closing of the two grippers. Conversely, when the grippers spread, causing the gripper 11 to rotate in a clockwise direction with respect to the gripper 10, the setscrew 68 allows the plunger 64 to move downwardly to its limit position determined by the head thereon.

Mounted on the beam 63 is a strain gauge 71 which produces an electrical signal which is a function of the deflection of the beam 63. The value of such signal is therefore a function of the position of the gripper 10 with respect to the gripper 11. For example, when the fingers 41 and 42 move toward each other in the absence of a workpiece 18, the two grippers 10 and 11 move to their maximum closed position determined by the setting of the screws 46 and 47, and the setscrew 68 bends the beam up toward the stop surface 67.

In such closed position, which exists when a workpiece does not cause opening of the grippers, the strain gauge produces a signal having one extreme value. Such value will be either a maximum value or a minimum value, depending upon the connections of the strain gauge. However, when the fingers 41 and 42 engage a workpiece 18, the grippers 10 and 11 are caused to open, causing the plunger 64 to be moved downwardly, as viewed in FIG. 2, and the value of the signal generated by the strain gauge is changed as a direct function of the amount of movement between the two grippers.

The various adjustments are arranged so that when a workpiece 18 is properly gripped between the two fingers 41 and 42, the two grippers 10 and 11 move to a position in which the plunger 64 is spaced from its lowermost position determined by the head thereon and a signal is generated by the strain gauge which has a value indicating that the workpiece is properly gripped. In the event, however, that a workpiece becomes misaligned during the gripping, the fingers are spread an additional amount, causing the plunger to move downwardly to a position beyond the position assumed when a workpiece is properly gripped and provides a signal indicating that the workpiece is misaligned in the gripper fingers.

If the misalignment is sufficiently great, or if the workpiece becomes hung up in the tooling at the gripping position, the fingers move apart to a degree causing the setscrew 68 to move away from the plunger and the plunger assumes its maximum downward travel. In such position, the signal has its other extreme value. Because the excessive opening of the grippers 10 and 11 moves the setscrew 68 away from the plunger, excessive strains cannot be applied to the signal generating assembly and the beam cannot be overstressed.

With this embodiment, the signal generated by the strain gauge 71 has a value which is a function of the relative positions of the two grippers 10 and 11, since one end of the beam 63 is carried by the gripper 10 and the other end of the beam is positioned by the setscrew 68 carried by the gripper 11. With this embodiment, usable signal deviations or differences in signal value represent positional variations of the gripper fingers 41 and 42 in the order of a few thousandths of an inch, so the signal value very accurately represents the position of the gripper fingers. The signal is transmitted through a conductor 72, illustrated in FIG. 3, to a control device discussed below.

Figure 4:
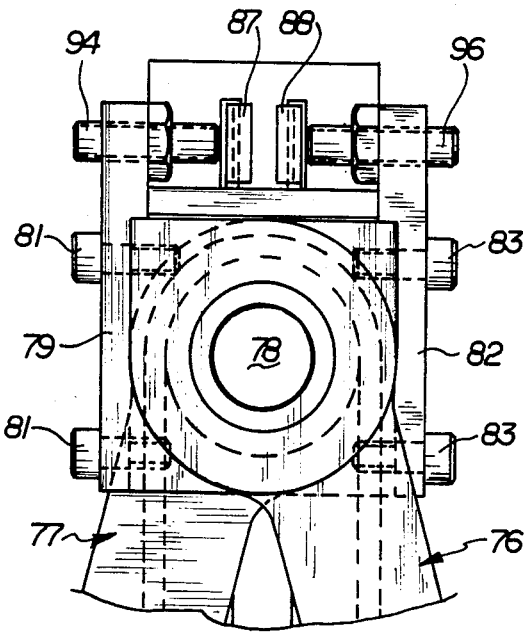
FIG. 4 is a fragmentary view of a second embodiment of this invention, in which a separate beam with a strain gauge mounted on each beam is associated with each gripper of a pair of grippers to produce signals which are a function of the position of the individual grippers of a pair of grippers.
Figure 5:
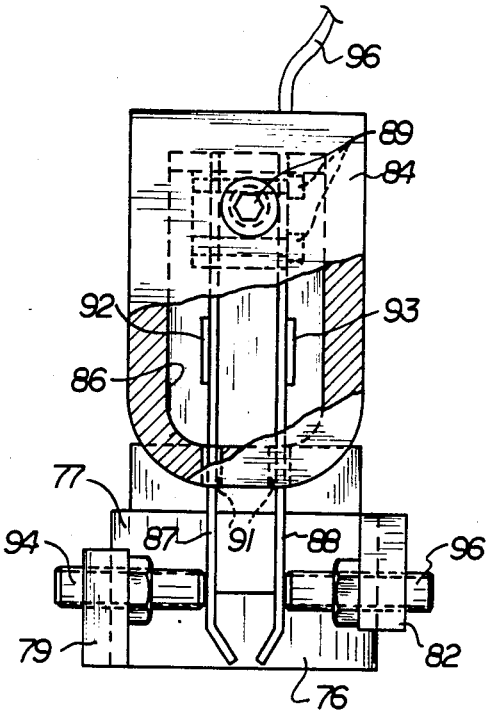
FIG. 5 is a plan view of the embodiment illustrated in FIG. 4.

FIGS. 4 and 5 illustrate another embodiment of this invention, which again employs deflectable beams and strain gauges. However, in this embodiment, two separate signals are generated, with one signal indicating the position of one gripper with respect to the gripper support and the other signal generated to correspond with the position of the other gripper with respect to the gripper support.

In this embodiment, the lower portions of the grippers have the same structure as the grippers illustrated in the first embodiment. However, the upper structure is modified to provide a different type of sensor or signal generating system. The gripper 76 corresponds to the gripper 10 of the first embodiment, and the gripper 77 corresponds to the gripper 11 of the first embodiment, and both grippers are pivoted for rotation about a pivot axis 78. Here again, a crossover-type system is provided, with the gripper 76 providing an upper extension 79 on the opposite side of the pivot secured to the gripper 76 by bolts 81. A similar but opposite upper extension 82 is bolted with bolts 83 to the gripper 77.

Referring now to FIG. 5, a sensor housing 84 is secured to the transfer support (not illustrated), and defines a cavity 86 along which a pair of deflectable beams 87 and 88 extends. Each of the beams 87 and 88 is mounted at one end by a fastener 89, and extends through an associated opening 91 in the housing to a free end positioned between the two extensions 79 and 82. A strain gauge 92 is mounted on the beam 87, and a similar strain gauge 93 is mounted on the beam 88.

A screw 94 is threaded into the upper end of the extension 79 and is adjusted to a position in which its inner end abuts with the free end of the beam 87. A similar screw 96 is threaded through the extension 82 and abuts at its inner end with the beam 88. Therefore, when the gripper 76 pivots in an anticlockwise direction or direction of gripper opening, the screw 94 moves to the left, allowing the beam 87 to bend toward its position of less stress until the beam 87 engages the adjacent side of the associated opening 91 to limit further movement in such direction. Similarly, when the gripper 77 rotates in a clockwise direction as viewed in FIG. 4, the screw 96 moves to the right allowing the beam 88 to bend towards its position of less stress until beam 88 engages the adjacent wall of its associated opening 91. Therefore, as the grippers open excessively, the screws 94 and 96 move away from the beams and overstressing of the beams cannot occur. Conversely, when the grippers close against the stops described in connection with the first embodiment, the two screws 94 and 96 move inwardly, but their travel is sufficiently limited so that overstressing cannot occur.

The adjustment screws 94 and 96 are adjusted so that when a workpiece is properly gripped by the grippers, the two beams 87 and 88 are in a midposition, and the two strain gauges 92 and 93 generate signals which are lower than the maximum signal and higher than the minimum signal. The signal generated by each of the strain gauges has a value which is a direct function of the position of the associated gripper with respect to the transfer frame. These signals are again transmitted to conductors 96 to a control mechanism for the machine, as discussed below.

The principal difference between this second embodiment of FIGS. 4 and 5 and the first embodiment of FIGS. 1 through 3 is that, in the first embodiment, the signal generated is a function of the relative position of the grippers 10 and 11, whereas the signals generated by the two strain gauges in the embodiment of FIGS. 4 and 5 are individually a function of the position of the individual grippers 76 and 77 with respect to the gripper supports.

Figure 6:
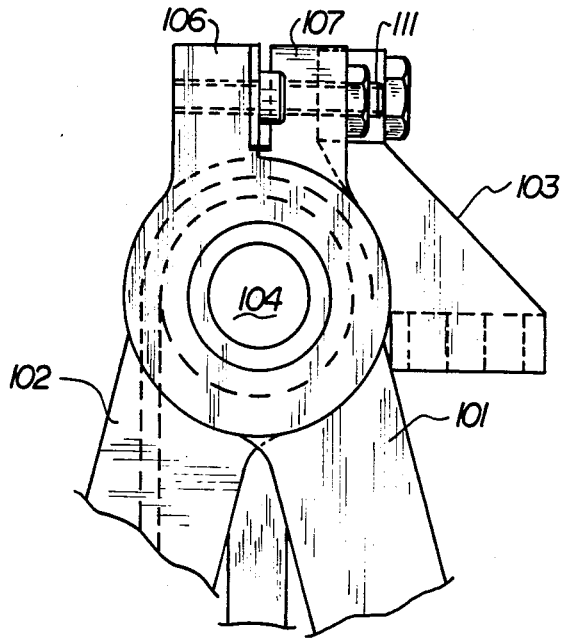
FIG. 6 is a fragmentary view of a third embodiment of this invention, in which a single beam is deflected to positions determined by the relative positions of the two grippers of a pair of grippers, and in which a sensor generates a signal which is a function of the position of the free end of the beam.
Figure 7:
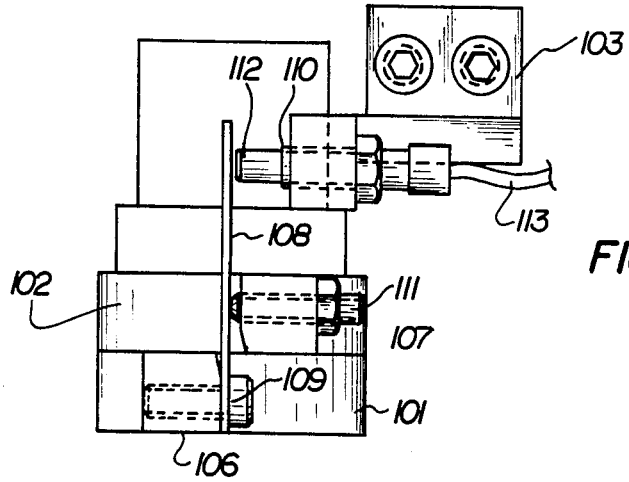
FIG. 7 is a plan view of the embodiment illustrated in FIG. 6.

FIGS. 6 and 7 disclose still another embodiment of this invention. In this embodiment, there are again two pivoted grippers 101 and 102 pivoted on a support 103 for rotation about a common pivot axis 104. Here again, the gripper 101 has the same shape and structure below the pivot as the gripper 10 of the first embodiment, and the other gripper 102 has the same shape and structure below the pivot as the gripper 11 of the first embodiment. In this embodiment, however, the gripper 101 is provided with an upper extension 106 and the gripper 102 has an upper extension 107.

Referring to FIG. 7, a deflectable beam 108 is mounted at one end on the projection 106 of the gripper 101 by a bolt 109. The free end of the beam 108 is located rearwardly adjacent to a signal generating device 110 and passes an adjusting screw 111 threaded into the upper projection 107 of the gripper 102. One signal generating device which may be used is marketed by Electro Corporation of Sarasota, Fla., under the trademark "ELECTRO-MIKE." Such device very accurately produces a signal which is a function of the spacing between the end of its probe 112 and the end of the beam.

In this embodiment, a signal is again generated which is a function of the relative positions of the two grippers 101 and 102. If the gripper 101 moves in an anticlockwise direction as viewed in FIG. 6, it carries the beam 108 to the left as viewed in FIG. 7 relative to the adjusting screw 111, so that the beam can assume a relatively straight position. On the other hand, if the grippers close, the upper end 106 of the gripper 101 moves to the right as viewed in FIG. 7, and the upper end 107 of the gripper 102 moves to the left as viewed in such figure, causing the beam 108 to be bent, moving the free end thereof to the left away from the probe 112 of the signal generator 110. Here again, the system is adjusted so that movement to the fully closed position, indicating that no workpiece is being gripped, causes a deflection of the beam 108 to a maximum deflection position which is within its elastic limit and that movement of the grippers in the opening direction to a position for properly gripping a workpiece still provides some deflection of the beam.

In the event that the grippers move to an excessively open position to indicate that a workpiece is hung up in the dies or is sufficiently misaligned to prevent proper functioning of the machine, the beam moves to its substantially unstressed condition and the generator 110 produces a signal value which is either a maximum or a minimum in the value range, depending upon the manner of connecting the signal generating device 110. Therefore, with this embodiment, a modulated signal is again generated in which a positive indication is presented as to the absence of a workpiece in the gripper, the presence of a properly gripped workpiece, or the presence of an improperly or misaligned gripped workpiece. Since the value of the signal varies as a function of gripper position, the machine operator can determine the degree of misalignment if the workpiece is not properly aligned in the transfer. Here again, the signal generated by this embodiment is transmitted through a conductor 113 to a control mechanism for the machine.

Figure 8:
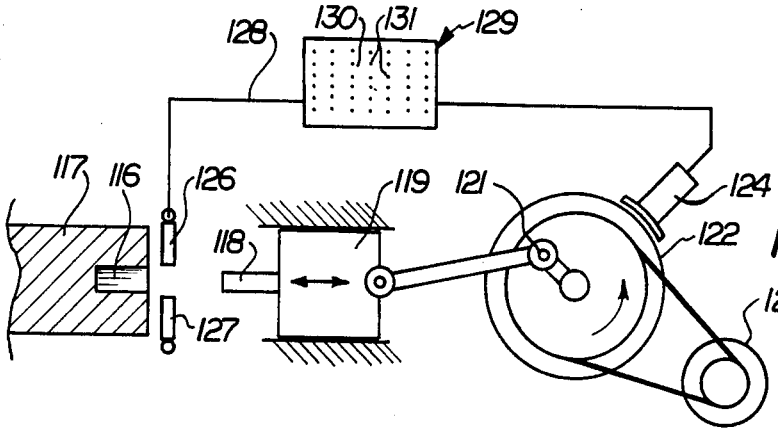
FIG. 8 is a fragmentary, schematic view of a machine incorporating the present invention, illustrating schematically the control which receives the signals generated by the sensors and operates to provide a visual indication to the gripping operation and also operates the emergency stop brake of the machine.
Figure 9:
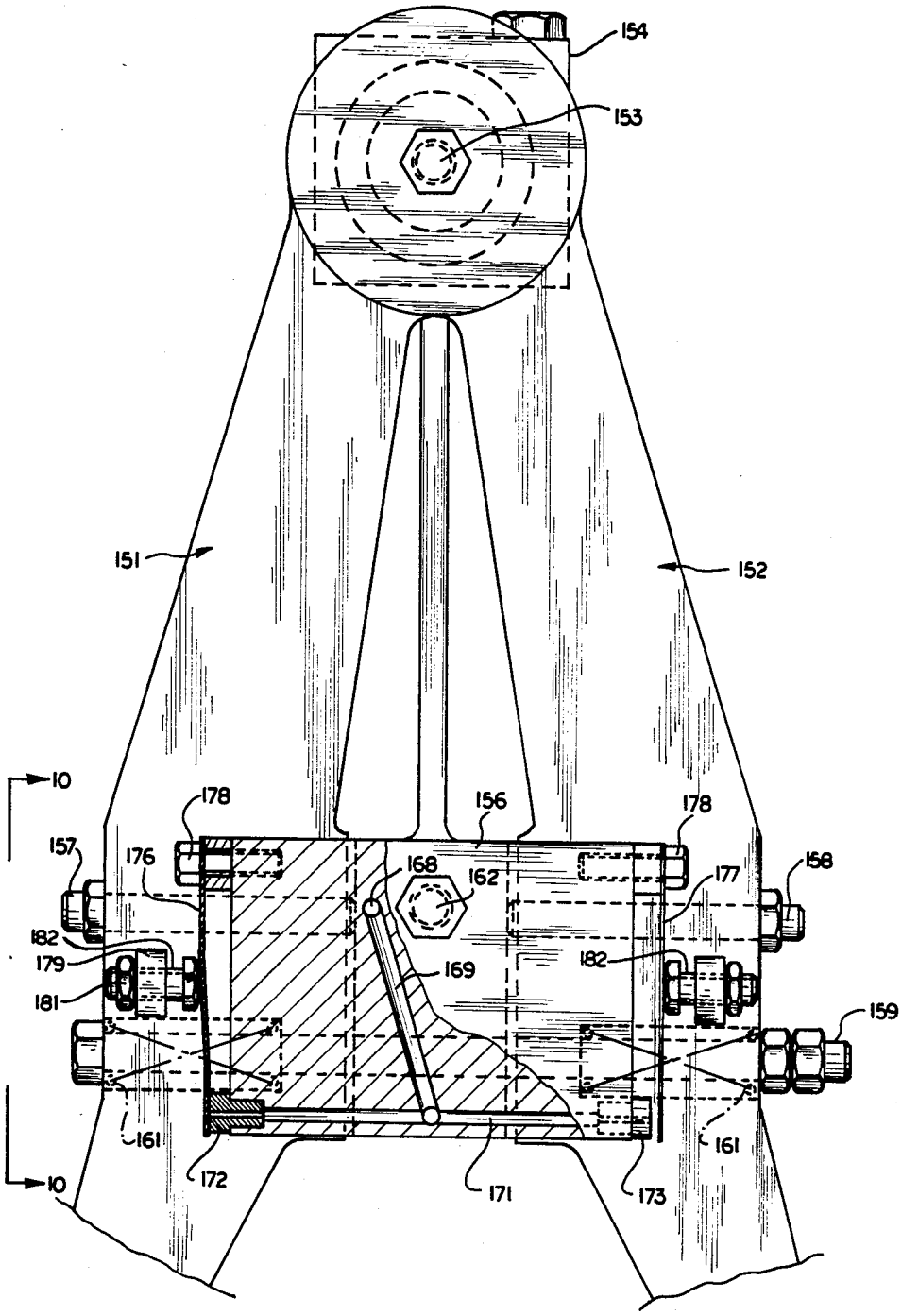
FIG. 9 is an enlarged, fragmentary section of an embodiment which utilizes a pneumatic signal generating system.
Figure 10:
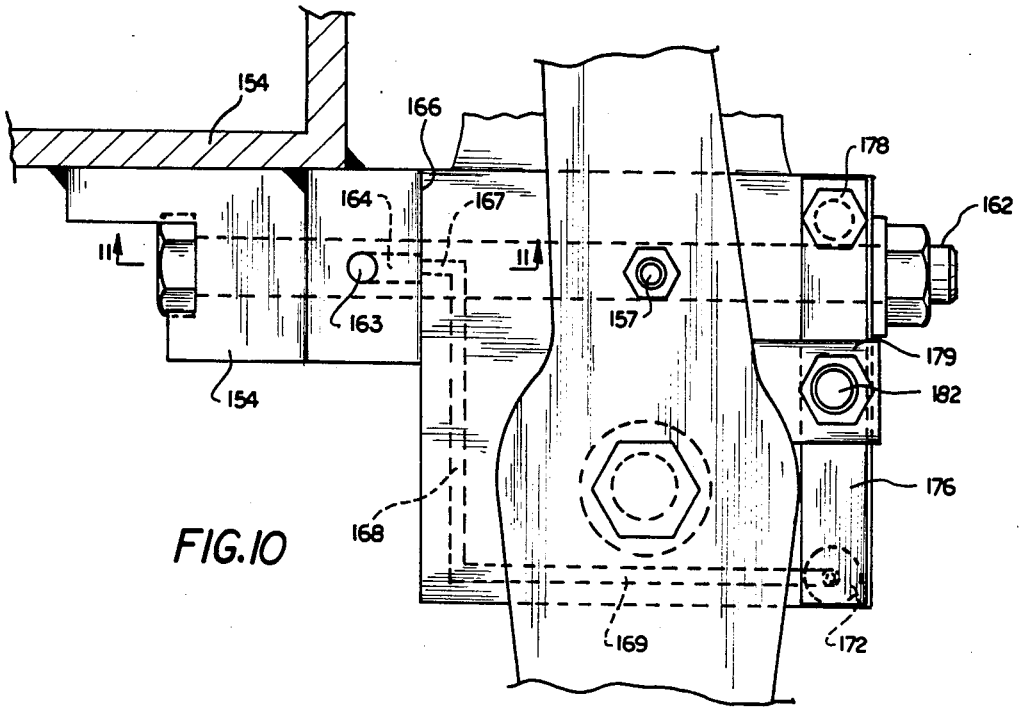
FIG. 10 is a fragmentary section taken along line 10—10 of FIG. 9.
Figure 11:
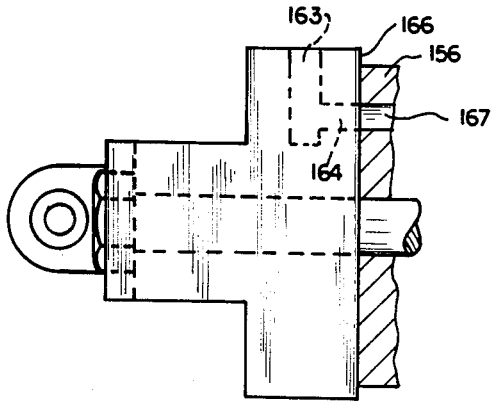
FIG. 11 is a fragmentary section taken along line 11—11 of FIG. 10.

FIG. 8 schematically illustrates a machine for forging workpieces, including a transfer providing a signal generating system in accordance with any of the three embodiments discussed above. In such machines, a die 116 is mounted in a fixed die breast 117 and a tool 118 is mounted on a reciprocating slide 119. The slide is reciprocated back and forth by a crank and Pitman drive 121 in response to rotation of a flywheel 122 driven by a motor 123. Such machine is provided with an emergency stop brake, schematically illustrated at 124, which is operable to stop the machine quickly to prevent damage to the tooling, including the die 116 and the tool 118.

The machine is also provided with a schematically illustrated transfer providing upper pivoted grippers 126 and lower fixed grippers 127, which are operable to cooperate and grip a workpiece at a gripping position and to transfer the workpiece to a work station, where it is subsequently worked by the tooling of the machine. Such grippers are provided with signal generating devices of the type illustrated in any one of the three embodiments discussed in detail above.

The signal is transmitted through a conductor 128 to a control 129. Such control is preferably arranged to provide the machine operator with a visual indication of the various grippers of the transfer. For example, if the machine provides multiple work stations and multiple grippers to sequentially move the workpieces from one work station to the next, the control should be provided with a visual indicator of the signal or signals generated by each pair of grippers.

The visual indicators schematically illustrated at 131 include rows of vertically aligned lights 130 which are controlled so as to light as a function of the associated signal. For example, if a workpiece is properly gripped, the lower half of the lights in the associated row will light and the upper half of the lights do not light. If a workpiece is misaligned, additional lights light, indicating by the number of additional lights that light the amount of misalignment. The control is positioned where the lights can be viewed by the operator during the operation of the machine. The control 129 is also provided with a system which operates the brake 124 in the event that a condition is present requiring the automatic emergency stopping of the machine. If, for example, the tooling in the machine is such that the absence of a workpiece will cause tooling damage, the control is set to operate the emergency stop brake 124 in the event that a signal is supplied to the control indicating the absence of a workpiece in one or more of the grippers of the transfer. Similarly, the control is arranged to operate the brake 124 to immediately stop the machine in the event that the signal is produced indicating the improper gripping of a workpiece so as to produce tooling or machine damage. These automatic functions protect the machine against a "wreck" which could damage the tooling or the machine. However, the control 129 provides for continued operation in the event that the misalignment is so minor as to not affect the proper operation of the machine.

Because the control provides a visual indication of the operation of the gripper, the machine operator can determine, for example, that one or more of the grippers is functioning to grip the workpiece or workpieces in a slightly misaligned manner, or if the gripping is being performed in an ideal, correct manner. If the operator notes that one or more of the grippers is deviating some small amount from the ideal gripping operation, indicating a slight misalignment, the machine can continue to operate but the operator is aware of the amount of deviation of proper gripping and can take appropriate action to correct the problem or allow the machine to operate as desired.

Because the operator is provided with a visual indication of the operation of each of the gripper assemblies, the operator can fully monitor the operation of the machine and in the event that a dangerous condition does exist, the control is set to automatically stop the machine when such dangerous condition exceeds limits set on the control 129. Since the grippers grip a workpiece only during a portion of the machine cycle, the control provides means to time the evaluation of the signals generated with the cyclic operation of the machine.

One suitable control which can be used in the machine is marketed by the Helm Instrument Company, Inc., of 4511 South Avenue, Toledo, Ohio, under the trademark MULTIGARD. It is believed that such control is covered by one or both of the U.S. Pat. Nos. 4,119,918 and 4,199,758. It should be understood that other suitable control systems may also be provided by a person skilled in the art so long as he provides the functions discussed above for the control 129.

FIGS. 9 through 12 illustrate still another embodiment of this invention in which a pneumatic system is provided for producing a signal to indicate that a workpiece is improperly gripped. Referring to FIG. 9, this embodiment again utilizes a pair of opposed grippers 151 and 152, which are mounted for opposed pivotal reciprocation about a pivot axis 153 on the transfer frame 154. Such grippers are substantially identical in structure and function to the grippers 38 and 39 illustrated in FIG. 1. A keeper 156 is again provided to guide the gripper arms in their opening and closing movements and to provide a portion of the transfer frame against which the positioning screws 157 and 158 abut. Such screws are threaded into the respective grippers and are adjustable to limit the inward movement of the grippers when a workpiece is not being gripped. Here again, a bolt 159 and springs 161 coact to resiliently urge the grippers toward each other. The keeper assembly is normally retained in position by a breaker bolt 162, best illustrated in FIG. 10, which bolts through the keeper to the frame 154, and normally maintains the keeper, and in turn the grippers, in the operating position. If a jam is encountered, such bolt breaks to prevent severe damage to the grippers and the transfer assembly itself. If, for example, a workpiece hangs up on the tooling, the breaker bolt 162 breaks and allows the fingers to swing up to the side as the transfer moves from one position to the next.

Compressed air is supplied to the keeper through a passage system including a supply passage 163, which connects to a forwardly extending passage 164 open to the face 166 against which the keeper is positioned by the breaker bolt. Such passage 164 connects to an aligned passage 167 in the keeper and, through passages 168 and 169, connects to a lateral passage 171, illustrated in FIG. 9. First and second bleed orifices 172 and 173 are mounted in the ends of the passage 171 to provide a bleed orifice associated with each of the grippers 151 and 152.

Associated with each of the bleed orifices 172 and 173 are leaf springs 176 and 177, respectively. Each of the springs is mounted at one end by an associated bolt 178 to the keeper 156 and provides a free end aligned with the associated orifice 172 and 173. Mounted on the gripper 151 for operation of the beam-type leaf spring 176 is an adjusting screw 182 which threads through a boss 179 on the gripper arm 151 and is locked in its adjusted position by a lock nut 181. A similar adjusting screw 182 is mounted on the gripper 152 for operation of the leaf spring 177. The leaf springs are mounted so that they move away from the associated orifice when unstressed and are movable with bending action by the associated screws 182 into engagement with the associated orifices when the grippers pivot inwardly toward their closed position. In such closed position, the two leaf springs close the associated orifices. However, when either of the grippers moves outwardly to a predetermined position determined by the adjustment of the screws 182, the free ends of the leaf springs move away from the associated orifices and allow the fluid under pressure in the passages to be bled from the system.

Figure 12:
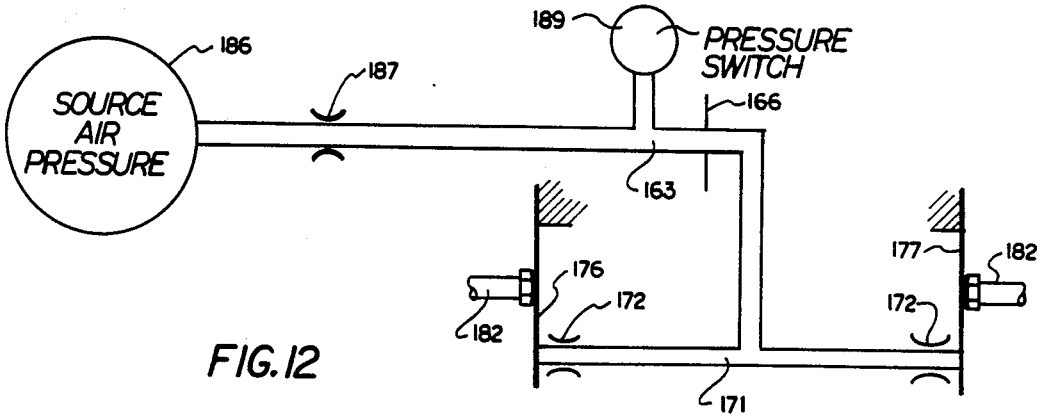
FIG. 12 is a schematic diagram of the pneumatic circuit of the embodiment of FIGS. 9 through 11.

FIG. 12 schematically represents the pneumatic system and the signal generating device of this embodiment. In such system, the lateral passage 171 is pressurized by a source of air pressure 186 connected to the passage system. Ahead of the face 166 is a pressure switch 189 which operates to produce a signal when the pressure in the passage 163 drops to some predetermined value. Normally, the switch should be such that it is open and does not produce any electrical signal when the pressure switch is exposed to the normal operating pressure of the system. However, if the pressure within the passage 163 drops to a predetermined value, which is reached in the passage 163 when either of the bleed orifices 172 is opened, an electrical signal is generated to indicate that the bleed orifices are open. In the schematic illustration of FIG. 12, a flow restriction is illustrated at 187. However, in practice, the supply piping may provide sufficient restriction to flow and a separate restrictor need not be provided in such instance.

The adjusting screws 182 are adjusted so that when the grippers are fully closed to a position determined by the screws 157 and 158, which is the position they assume if no workpiece is present, the two bleed orifices 172 and 173 are closed by their associated springs 176 and 177. In such condition, the pressure switch 189 is exposed to full supply pressure and remains open. Similarly, when a workpiece is properly gripped, the adjusting screws 182 continue to maintain the leaf spring against the orifices and system pressure remains on the pressure switch 187. However, if the grippers are gripping an improperly gripped workpiece, one or both of the grippers move further apart to a position in which one or both of the springs 176 and 177 move away from associated bleed orifices to allow escape of the air through the bleed orifices and a corresponding reduction in pressure applied to the pressure switch 187. In such event, the pressure switch closes and produces a signal indicating that the workpiece is improperly gripped. Usually in such instance, the controls of the machine are arranged so that the emergency stop mechanism of the machine is actuated to stop the machine and prevent damage to the tooling.

In practice, it has been found that a signal can be reliably established when the grippers move apart because of an improperly gripped workpiece a very small amount, in the order of 0.030 inch. Therefore, the system is very sensitive in detecting misalignment of workpieces. Because the leaf springs are resilient, however, they can accommodate overtravel in the closing direction between the position which they assume when the workpiece is properly gripped and the fully closed position in which no workpiece is present in the gripping system. This particular embodiment, like the other embodiments described above, provides a very simple mechanism which is easily adjusted and which can function reliably in the hostile environment present in a forging machine. Further, since the orifices remain closed during normal operation, the likelihood of debris entering the orifices is virtually non-existent. In fact, any debris close to the orifice is blown out when the bleed orifices are open, so clogging of the orifices, even in this hostile environment, does not present a problem. Additionally, because the adjustment is fully exposed, and because the system is very simple in structure, an operator does not have difficulty in adjusting the system for proper operation.

It should be noted that if the breaker bolt 162 stretches or is broken, leakage occurs at the face 166, which also produces a signal that may be used to stop the machine. The assignee of the present invention has utilized a system in which leakage at the face 166 has been used to establish a signal indicating that the breaker bolt is stretched or broken in order to automatically stop the machine, and that such system constitutes prior art with respect to this invention. Such system, however, did not provide a means for accurately establishing misalignment of a workpiece, since it did not provide a bleed system responsive to gripper position.

With the present invention, signal generating means are provided which accurately reflect the operating condition of a transfer for a forging machine and the like. Such signal generating means are simple in structure and reliable in operation, and are capable of providing unable signal variations reflecting very small displacements from normal gripping. For example, usable signal variations can detect movement of the grippers in the range of a few thousandths of an inch.

Although the preferred embodiments of this invention have been shown and described, it should be understood that various modifications and rearrangements of the parts may be resorted to without departing from the scope of the invention as disclosed and claimed herein.

What is claimed is:

1. In a forging machine providing a work station at which workpieces are formed and a transfer operable to grip a workpiece at a gripping location and transfer such workpiece to said work station, said transfer comprising a transfer frame, gripper means on said transfer frame providing at least one substantially rigid gripper, non-deformable connection means connecting said gripper and frame permitting movement of said gripper relative to said transfer frame, said gripper means including operating means operable to create a gripping force causing said gripper to assume a predetermined position when a workpiece is properly gripped and to assume other positions when a workpiece is improperly gripped, and signal generating means independent of operating means connected to said gripper operable to produce a signal which is a function of the position of said gripper and which is independent of said gripping force, said signal having a predetermined value when said workpiece is properly gripped and other values which are a function of the amount said gripper is displaced from said predetermined position to indicate that a workpiece is not properly gripped.

2. A forging machine as set forth in claim 1, wherein said gripper means provides a pair of substantially rigid grippers which are supported by said frame by non-deformable connections and are movable relative to said frame and move to a predetermined position relative to each other when a workpiece is properly gripped and other positions relative to each other when a workpiece is improperly gripped, and said signal means generates a signal which is a function of the position of said grippers relative to each other.

3. A forging machine as set forth in claim 1, wherein said gripper means includes a pair of substantially rigid grippers which are supported on said frame by non-deformable connections and are movable relative to said frame and move to a predetermined position relative to each other when a workpiece is properly gripped and to other positions relative to each other when a workpiece is improperly gripped, and said signal means produces a separate signal for each gripper which is a function of the position of each gripper with respect to said transfer frame.

4. A forging machine as set forth in claim 1, wherein said signal means includes deflectable beam means separate from said gripper the deflection of which is determined by the position of said gripper, said signal means is operable to produce a signal which is determined by the deflection of said beam, and connector means connecting said deflectable beams to said gripper structured so that movement of said gripper cannot overstress said beam.

5. A forging machine as set forth in claim 4, wherein said gripper is movable to a maximum position, said beam means being connected for deflection by said gripper a maximum amount when said gripper is in said maximum position, said beam means being connected for deflection by said gripper only until said gripper moves from said maximum position a predetermined amount to prevent overstressing of said beam means.

6. A forging machine as set forth in claim 1, wherein said forging machine provides an emergency stop brake, and said signal is operable to operate said emergency stop brake when a workpiece is sufficiently improperly gripped to cause possible damage to said machine.

7. A forging machine as set forth in claim 6, wherein said signal is supplied to a control which provides the operator of the machine with a visual indication of the operation of the grippers.

8. A forging machine as set forth in claim 6, wherein said signal is supplied to a control which in turn operates an emergency stop brake when the signal deviates from the value produced when a workpiece is properly gripped by predetermined amounts, said control being adjustable to change said predetermined amounts.

9. A transfer for forging machines or the like for transferring workpieces from a first location to a second location, comprising a movable transfer support, a pair of substantially rigid grippers pivoted on said support, resilient means biasing said grippers in a gripping direction relative to each other, said grippers when gripping a workpiece moving relative to each other against the action of said resilient means in a direction opposite said gripping direction, the position of said grippers relative to each other when gripping a workpiece being determined by the size and position of said workpiece in said grippers, said transfer support and grippers being operable to grip a workpiece at said first location and to move such workpiece to said second location, and signal means connected to said grippers operable to produce signals having a value which is a function of the position of said grippers, said signal when having a value within a predetermined range establishing that a workpiece is properly gripped for transfer and when having a value outside of said range indicating that a workpiece is not properly gripped for transfer, and wherein said grippers are movable toward each other to a maximum closed position, said beam means being connected for deflection by said grippers a maximum amount when said grippers are in said maximum closed position, said beam means being connected for deflection by said grippers only until said grippers move apart a predetermined amount to prevent overstressing of said beam means.

10. A transfer as set forth in claim 9, wherein said beam means includes a separate beam associated with each gripper.

11. A transfer as set forth in claim 9, wherein said beam means provides a beam which is deflected an amount determined by the relative position of said grippers.

12. A transfer as set forth in claim 9, wherein said signal generating means is a strain gauge mounted on said beam means.

13. In a forging machine providing a work station at which a workpiece is formed and a transfer operable to grip a workpiece at a gripping location and to transfer such workpiece to said work station, said transfer comprising a transfer frame, gripper means on said transfer frame providing at least one gripper movable relative to said transfer frame between a first gripper position when a workpiece is properly gripped and a second gripper position when a workpiece is improperly gripped, a beam providing a portion movable from a first beam position to a second beam position in response to movement of said gripper from said first gripper position to said second gripper position, and signal generating means operable in response to movement of said beam to said second beam position to produce a signal indicating that a workpiece is improperly gripped, said signal generating means including a fluid pressure system providing an orifice, said orifice being closed in one of said beam positions and open in the other of said beam positions, said signal generating means also including a pressure-sensitive signal generator operable in response to pressure changes created by opening and closing of said orifice.

14. A forging machine as set forth in claim 13, wherein said gripper means includes an opposed similar gripper which coacts with said one gripper to grip a workpiece and a second beam and a second orifice is associated with said second gripper to produce a signal when said second gripper moves to its second gripper position.

15. In a forging machine providing a work station at which workpieces are formed and a transfer operable to grip a workpiece at a gripping location and to transfer such workpiece to said work station, said transfer comprising a transfer frame, gripper means on said transfer frame providing at least one gripper movable to a first gripper position when a workpiece is not gripped by said gripper means, a second gripper position when a workpiece is properly gripped, and a third gripper position when a workpiece is improperly gripped, a resilient cantilever beam mounted at one location and bendable in response to movement of said gripper between said gripper positions, a bleed orifice connected to a source of fluid under pressure, said beam operating to close said orifice when said gripper is in said first and second gripper positions, and to open said orifice when said gripper is in said third gripper position, and pressure-responsive signal generating means operable in response to changes in pressure created by opening and closing of said orifice to generate a signal indicating said gripper is in said third gripper position.

16. A forging machine as set forth in claim 15, wherein said beam is a leaf spring mounted at one location on said transfer frame, an adjusting screw is provided on said gripper engageable with said beam operable to bend said beam in response to movement of said gripper between said gripper positions, said orifice is mounted on said gripper frame and is engaged by a portion of said beam remote from the mounting thereof to close said orifice when said gripper is in said first and second gripping position, said beam providing sufficient resilience to accommodate movement of said gripper between said first gripper position and said second gripper position without opening said orifice.

* * * * *